United States Patent [19]

Bortfeld et al.

[11] 4,124,810

[45] Nov. 7, 1978

[54] ELECTRON GUN HAVING A DISTRIBUTED ELECTROSTATIC LENS

[75] Inventors: David P. Bortfeld, Kendall Park; Roger W. Cohen, Trenton; David A. de Wolf, Princeton, all of N.J.

[73] Assignee: RCA Corporation, New York, N.Y.

[21] Appl. No.: 804,004

[22] Filed: Jun. 6, 1977

[51] Int. Cl.[2] ..... H01J 29/46; H01J 29/56

[52] U.S. Cl. ..... 315/15; 313/414; 313/449

[58] Field of Search ..... 315/14, 15, 382, 31 R, 315/31 TV; 313/414, 412, 448, 449, 458, 460

[56] References Cited

U.S. PATENT DOCUMENTS

| | | | |
|---|---|---|---|
| 3,417,199 | 12/1968 | Yoshida et al. | 315/14 |
| 3,517,242 | 6/1970 | Pappadis | 313/414 |
| 3,740,607 | 6/1973 | Silzars et al. | 315/15 |
| 3,889,146 | 6/1975 | Koizumi et al. | 313/414 |
| 3,890,528 | 6/1975 | Say et al. | 313/414 |
| 3,932,786 | 1/1976 | Campbell | 313/414 X |

*Primary Examiner*—Theodore M. Blum
*Attorney, Agent, or Firm*—E. M. Whitacre; G. H. Bruestle

[57] ABSTRACT

A color cathode ray tube includes an electron gun having a distributed lens system which yields smaller spot sizes on a phosphor screen at intermediate and higher cathode currents when compared with prior art electrostatic lenses having similar diameters. The lens establishes an essentially exponentially increasing potential distribution along the electron beam path.

6 Claims, 6 Drawing Figures

ELECTRON GUN HAVING A DISTRIBUTED ELECTROSTATIC LENS

BACKGROUND OF THE INVENTION

This invention relates to an electron gun assembly for use in a cathode ray tube and more particularly to a multi-beam electron gun assembly for use in color television picture tubes.

Conventional color-reproducing cathode ray tubes include a multi-color image screen having interspersed groups of red-emitting, blue-emitting and green-emitting phosphor elements. Excitation of these elements is provided by an inline or delta cluster of three electron guns which emit three electron beams, each of which is focused into a beam spot on the tube screen by means of an electrostatic electron lens. The size of the electron spots focused on the screen, and thus the picture resolution, is a result of many factors. An important factor is the set of aberrations, particularly spherical aberration, introduced by the focusing lens. In the presence of spherical aberration, all electrons emanating from an object point do not, after focusing, recombine at a common point.

Commercially available electron guns for color cathode ray tubes have focusing lenses of two basic types. One type is the so-called "unipotential" type lens comprising three electrodes, the first and third of which are maintained at the same potential, typically the screen voltage, and a second (intermediate) of which is maintained at a much lower potential. The other type is the so-called "bipotential" lens comprising a relatively low voltage electrode followed by a second electrode which is maintained at a relatively high voltage, typically the phosphor screen voltage.

Designers of prior art focusing lenses have reduced spherical aberration by increasing the ratio of lens diameter to beam diameter. However, increasing lens diameter conflicts with the space limitations imposed by the neck diameters of standard color tube bulbs which are deliberately made small in order to minimize the yoke driving power required to deflect the beams, to minimize convergence power requirements and to minimize residual convergence errors. Neck size constraints are perhaps most severe in color tubes of the "small-neck" type having an "in-line" electron gun arrangement. For this arrangement, the maximum diameter of the focused lens for each electron beam must necessarily be less than one third of the neck inner diameter.

One way of reducing spherical aberrations without increasing lens diameter is to increase the length of the electrostatic lens in order to minimize electron beam bending at any one point. This can be accomplished by distributing the lensing action along the length of the gun. Among prior art lenses which make use of this approach are a double-Einzel lens disclosed in U.S. Pat. No. 3,863,091 to Hurakawa, et al.; a distributed Einzel lens disclosed in U.S. Pat. No. 3,895,253 to Schwartz et al.; a tripotential lens disclosed in U.S. Pat. No. 3,995,194 to Blacker, et al.; and a multi-element lens disclosed in U.S. Pat. No. 3,932,786 to Campbell.

As indicated in the Schwartz et al. patent, the double-Einzel concept does not appear to offer any distinct advantages over the distributed Einzel which replaces the high-low-high-low-high voltage distribution of the double-Einzel with a high-medium-low-medium-high voltage distribution and thus achieves an improved distribution of the fields along the axis of the lens. Both techniques suffer from a major practical disadvantage in that the high ultor potential, typically on the order of 25–30 kV, is brought very close to the low voltage end of the gun, thus increasing its vulnerability to electrical discharges.

The multi-element lens disclosed in the Campbell patent, although allowing a desired gradation of the fields, uses a relatively complex structure comprising a plurality of individual, electrically conducting plates mounted in spaced parallel relationship.

The tripotential lens disclosed in the Blacker et al. patent comprises four separate lens elements. The lens element closest to the cathode has an intermediate voltage applied thereto which, in the specific embodiment disclosed, is equal to 12kV. Although this voltage is less than the ultor voltage, it is still sufficiently high so as to present potential electrical discharge problems due to the proximity of the associated lens element to the low voltage end of the gun.

SUMMARY OF THE INVENTION

An electron gun structure includes a beam forming region and a focus lens system. The focus lens system comprises first, intermediate and final accelerating and focusing electrodes spaced respectively along an electron beam path from the beam forming region. The intermediate electrode forms a substantially cylindrical electron lens element of radius R and length $L_m$ where $L_m$ is substantially equal to R. Also included is means for applying separate potentials to each electrode of the focus lens system. The magnitude of the applied potentials is monotonically increasing along the beam path.

DETAILED DESCRIPTION

Figure 1:
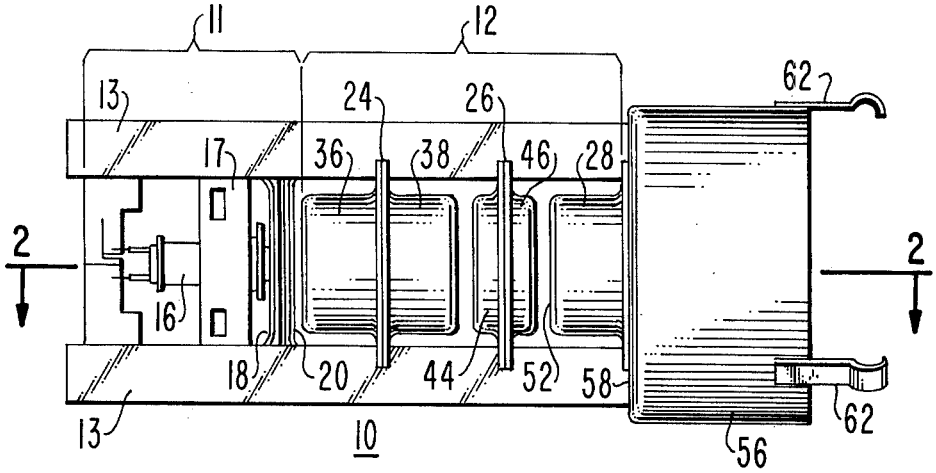
FIG. 1 is a side elevation view of a preferred embodiment of an electron gun having a distributed electrostatic lens in accordance with this invention.
Figure 2:
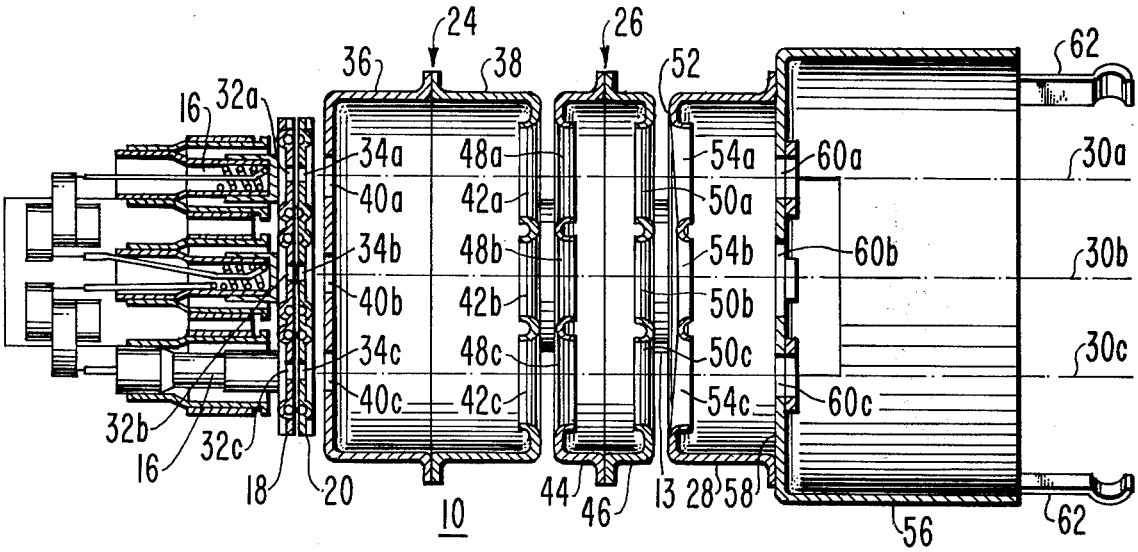
FIG. 2 is a sectional view taken on line 2—2 of FIG. 1.

Referring to FIGS. 1 and 2, an electron gun 10 comprises a beam forming region 11, a focus lens system 12 and two parallel glass support rods 13 between which the various elements of the beam forming region and focus lens system are mounted. The beam forming region 11 includes three cathodes 16 fastened to several support straps 17 which are supported at one end of the glass support rods 13. The beam forming region 11 also includes a control grid electrode 18 and a screen grid electrode 20 mounted on the rods 13 following the cathodes 16. The focus lens system 12 comprises first, intermediate and final accelerating and focusing electrodes 24, 26 and 28 respectively, mounted on the rods 13 in that order following the screen grid electrode 20.

The three cathodes 16 emit electrons which travel along three substantially coplanar beam paths 30a, 30b and 30c (see FIG. 2). The control grid electrode 18 and the screen grid electrode 20 are closely spaced flat metal elements constructed in accordance with the teachings of U.S. Pat. No. 3,772,554 to Hughes. The control grid electrode 18 contains three apertures 32a, 32b and 32c, each of which is aligned with a different beam path 30a, 30b and 30c. Similarly, the screen grid electrode 20 contains three apertures 34a, 34b and 34c, each of which is aligned with a different beam path 30a, 30b and 30c.

The first accelerating and focusing electrode 24 is mounted on the glass support rods 13 adjacent to but spaced from the screen grid electrode 20 and comprises first and second bathtub-shaped members, 36 and 38, joined at their open ends. The closed end of the first member 36 has three apertures 40a, 40b and 40c therein, each of which is aligned with a different beam path 30a, 30b and 30c. The closed end of the second member 38 also has three apertures 42a, 42b and 42c therein, each being aligned with a different beam path 30a, 30b and 30c. The first accelerating and focusing electrode 24 is electrically connected to a pin in a stem terminal (not shown) by means of an electrically conductive ribbon (not shown).

The intermediate electrode 26 is mounted on the glass support rods 13 adjacent to but spaced from the first electrode 24. In the preferred embodiment, this space is substantially equal to 1.27 mm. The intermediate electrode 26 comprises first and second bathtub-shaped members 44 and 46 joined at their open ends. The closed end of the first member 44 has three apertures 48a, 48b and 48c therein, each of which is aligned with a different beam path 30a, 30b and 30c. The closed end of the second member 46 has three apertures 50a, 50b and 50c therein, each of which is aligned with a different beam path 30a, 30b and 30c. In the preferred embodiment, the apertures 48a, 48b and 48c, and 50a, 50b and 50c each have a diameter substantially equal to 5.44 mm. The length $L_m$ of the intermediate electrode 26 is, in the preferred embodiment, substantially equal to 2.54 mm. The electrode 26 is electrically connected to a pin in the stem terminal (not shown) by means of an electrically conductive ribbon (not shown).

Each aperture 48a, 48b and 48c, together with its corresponding aperture 50a, 50b and 50c effectively forms a cylindrical accelerating and focusing electrode which surrounds its corresponding beam path 30a, 30b and 30c. In the preferred embodiment, each effective cylinder has a diameter substantially equal to 5.44 mm and a longitudinal axis which is 2.54 mm long. Note that although the preferred embodiment comprises an intermediate electrode which is common to the three beam paths and which effectively forms a shaped electrode for each of the three coplanar beam paths, the intermediate electrode could also comprise a separate cylindrical electrode for each beam path. A configuration such as this would be preferred where the first and final accelerating electrodes each comprise three separate cylindrical elements such as disclosed in U.S. Pat. No. 3,254,251.

The final accelerating and focusing electrode 28, comprising a bathtub-shaped member having a base 52, is mounted on the glass support rods 13, adjacent to but spaced from the intermediate electrode 26. In the preferred embodiment, this space is substantially equal to 1.27 mm. The base 52 faces toward the intermediate electrode 26 and has three apertures 54a, 54b and 54c therein, each of which is aligned with a different beam path 30a, 30b and 30c. Each electrode in the focus lens system 12 is sufficiently axially separated from adjacent electrodes to preclude arcing therebetween upon application of appropriate operating potentials (to be described hereafter) and yet the gaps are small enough to provide reasonable immunity to stray electron fields.

A shield cup 56 with a base 58 is attached to the final electrode 28 so that the base 58 covers the open end of the final electrode 28. The shield cup 56 has three apertures 60a, 60b and 60c through the base 58, with each aperture being aligned with one of the beam paths 30a, 30b and 30c. The shield cup 56 also has three bulb spacers 62 attached to and extending from the open end thereof. After the electron gun 10 is assembled inside a cathode ray tube (not shown), the bulb spacers contact the inside surface of the tube establishing an electrical contact between that surface and the final electrode 28.

Theory indicates, see for example H. Moss, "Narrow-Angle Electron Guns and Cathode-Ray Tubes," Academic Press, 1968 that $R_a$ is proportional to $C_a \cdot R_b^3$ where $R_a$ is the increase in electron beam spot size caused by lens aberrations; $R_b$ is the beam radius and $C_a$ is the coefficient of spherical aberrations. Thus, for a given beam radius, $R_a$ is minimized by minimizing $C_a$.

Figure 3:
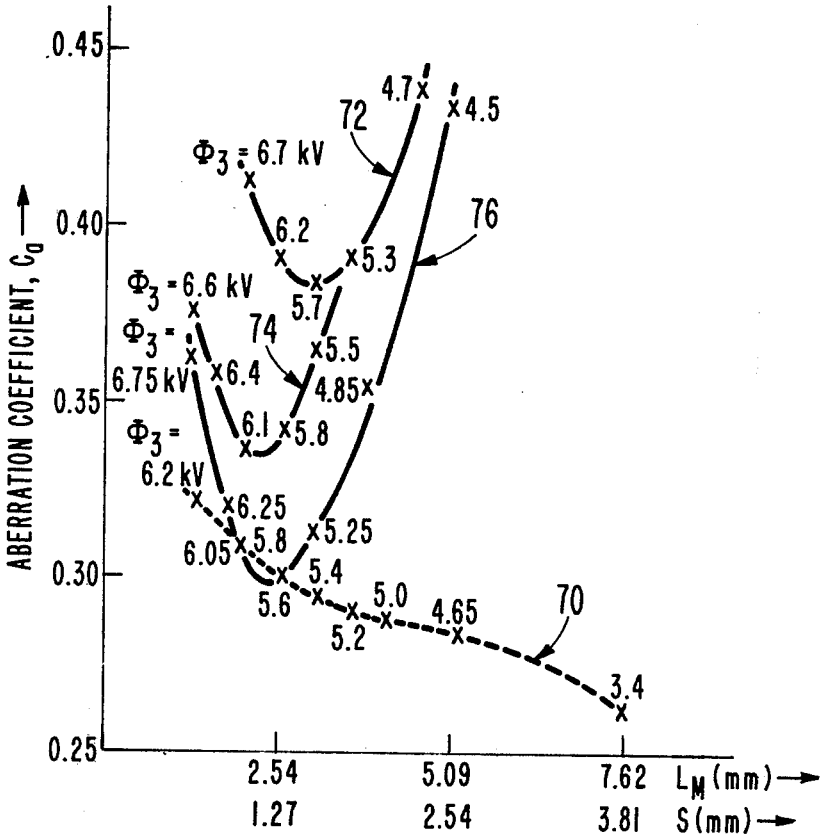
FIG. 3 is a plurality of curves showing the relationships of the coefficient of spherical aberration to the length of the intermediate electrode and to the gap length between the intermediate electrode and adjacent electrodes.

FIG. 3 is a plot of the magnitude of the aberration coefficient $C_a$ versus the length $L_m$ of the intermediate electrode 26 (curves 72, 74 and 76) and the spacings, or gap lengths S, between the intermediate electrode 26 and the adjacent first and final accelerating electrodes 24 and 28 (curve 70) for a three element focus lens system of the present invention having a lens diameter $d$ substantially equal to 5.44 mm. $\Phi_3$ is varied in each of these plots to maintain minimum spot size on the screen. As shown by curve 70 in FIG. 3, $C_a$ varies monotonically as a function of S, decreasing as S is increased, showing that weaker fields in the lens tend to reduce $C_a$. Consequently, the gap length is preferably large but is usually limited by other design considerations such as field isolation, suppresion of inter-lens crosstalk and physical dimensions of the tube. In the preferred embodiment disclosed herein, a gap length of 1.27 mm was found to be suitable.

As shown by curves 72, 74 and 76 in FIG. 3, $C_a$ exhibits a strong minimum as the length $L_m$ of the intermediate electrode 26 is varied. The magnitude of this minimum varies as a function of the voltage $\Phi_4$ applied to the intermediate electrode 26. For curve 72, the applied voltage $\Phi_4$ was 10 kV; for curve 74, $\Phi_4$ equaled 18 kV; and for curve 76, $\Phi_4$ equaled 14 kV, the intermediate voltage for the optimal case. As shown in FIG. 3, the best operating length of the intermediate electrode is approximately equal to 2.54 mm which is substantially equal to the radius of the lens, which has a diameter of 5.44 mm in this case; and the length is almost independent of the value of $\Phi_4$ applied. Note that the geometric scaling theorem of electron optics states that upon changing the geometry in such a way that ratios of lengths are preserved, the electron-optical performance remains unchanged; consequently, the finding that $L_m$ is substantially equal to the radius of the lens generally holds for all lenses of this type.

Insertion of the intermediate electrode 26 effects a gradation of the transition from a low focus potential $\Phi_3$ to anode potential $\Phi_5$ such that a smooth axial potential distribution is obtained which results in a single, coupled, bipotential, extended lens. In the optimum case this potential distribution is substantially exponential over most of its length. Consequently, the axial potential near the midpoint of the length of the intermediate electrode 26 should be substantially equal to the electrode voltage $\Phi_4$ which, in turn, should be substantially equal to the geometric mean $(\Phi_3 \cdot \Phi_5)^{\frac{1}{2}}$ of the voltages $\Phi_3$ and $\Phi_5$ applied to the first and final electrodes 24 and 28 respectively. The length $L_m$ of the intermediate electrode 26 must be such as to allow this to occur but not so long as to disturb the smooth, exponential-like growth of the axial potential. If the intermediate electrode 26 is made too short, its effect will not be felt on the axis; if it is too long the region within the electrode will become a field-free space causing the lens system to degenerate into two, decoupled bipotential lenses whose performance will be inferior to that of the present invention. As the preferred embodiment shows, this optimum length, $L_m$, must be substantially equal to the radius of the lens.

Figure 4:
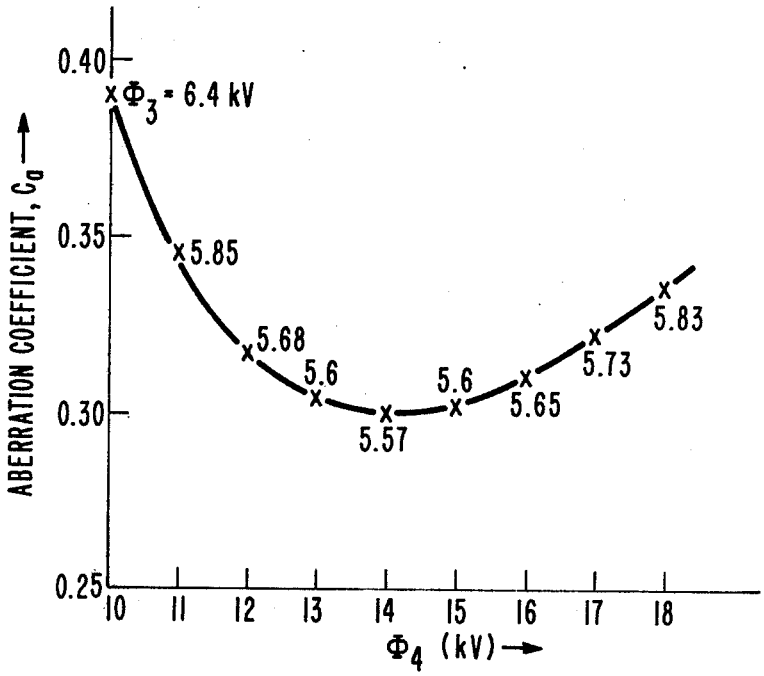
FIG. 4 is a graph showing the relationship of the coefficient of spherical aberration to the potential applied to the intermediate electrode of an electron gun of the present invention.

FIG. 4 is a plot of $C_a$ versus the potential $\Phi_4$, applied to the intermediate electrode 26 of the preferred embodiment, i.e., optimum geometry from FIG. 3, of a three element focus lens system of the present invention. The potential $\Phi_5$ applied to the final electrode 28 is substantially equal to 30 kV. The potential $\Phi_3$ applied to the first electrode 24 is used to adjust the lens strength to obtain a focused spot on the screen. In the embodiment herein the image focal length is substantially equal to 280 mm and is obtained with a value of $\Phi_3$ substantially equal to 5.6 kV. Since variation of $\Phi_4$ results in a change of the focal length of the lens, $\Phi_3$ must also be varied if a constant focal length is to be maintained. This variation is noted on the curve in FIG. 4. As indicated in FIG. 4, $C_a$ is minimized when $\Phi_3$ is substantially equal to 5.6 kV and $\Phi_4$ is substantially equal to 14 kV.

Theory also indicates that the spot size of the electron beam varies approximately as the $\frac{1}{4}$ power of the aberration coefficient $C_a$. As shown in FIG. 4, when $\Phi_4$ decreases from 14 kV to 10 kV, $C_a$ increases from approximately 0.30 to 0.39, an increase of about 30%. Calculations of the spot size under these conditions show an increase of about 7% which is in substantial agreement with theory. As $\Phi_4$ is further decreased, $C_a$ and consequently the spot size, will increase until it substantially reaches the size effected by a conventional bi-potential lens in which case $\Phi_4 = \Phi_3$. As also shown in FIG. 4, $C_a$ increases as $\Phi_4$ is increased above approximately 14 kV. However, the rate of change is less than it was for the decreasing $\Phi_4$. As $\Phi_4$ is increased, the spot size will continue to increase until it substantially reaches the size effected by a conventional bi-potential lens in which case $\Phi_4 = \Phi_5$. Consequently, an electron gun having a three element focus lens system in accordance with the present invention will always produce a smaller electron beam spot size than will the conventional prior art bipotential gun as long as $\Phi_3 < \Phi_4 < \Phi_5$ and the intermediate electrode length is substantially equal to the lens radius.

Figure 5:
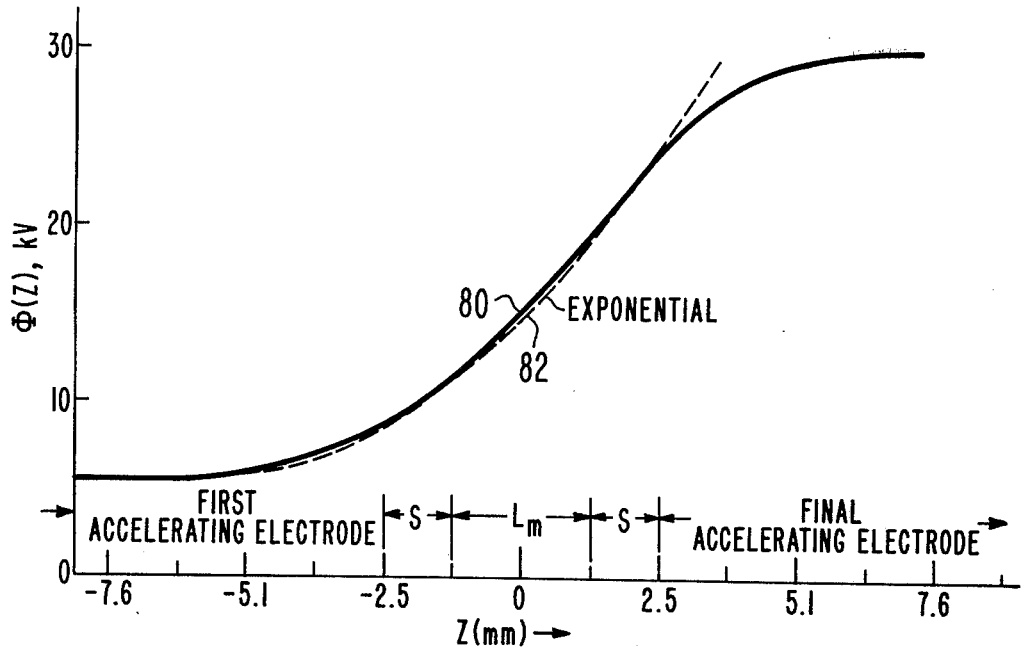
FIG. 5 is a graph showing the axial potential profile for an electron gun of the present invention.

FIG. 5 depicts the axial potential profile for the optimal case shown in FIG. 4, i.e., $\Phi_3$ substantially equal to 5.6 kV, $\Phi_4$ substantially equal to 14 kV and $\Phi_5$ substantially equal to 30 kV. As shown in FIG. 5, the axial potential profile for the optimal case, represented by curve 80, is monotonically increasing along the beam path and closely approximates an exponential curve 82 which has been included for comparison. Therefore, the axial potential at the center of the intermediate electrode is substantially equal to the geometric mean $(\Phi_3 \Phi_5)^{\frac{1}{2}}$ of the first and final electrodes.

Figure 6:
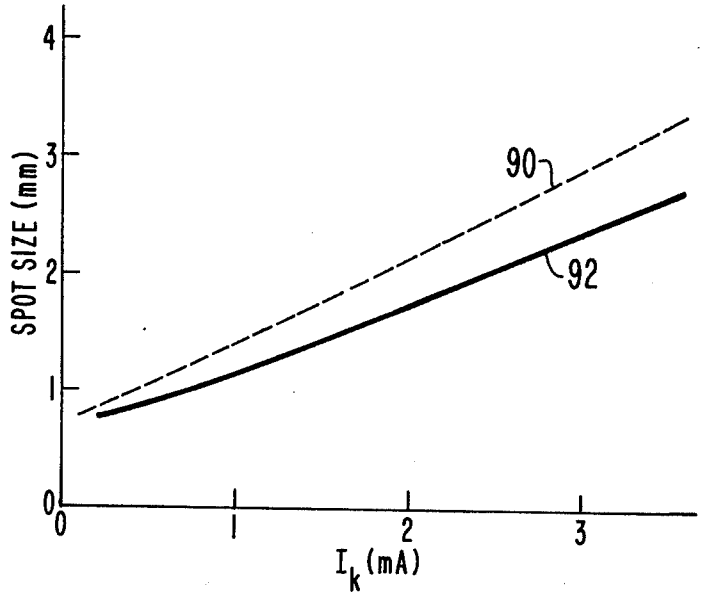
FIG. 6 is a graph showing the relationship of the spot size to beam current for an electron gun of the present invention, and for a prior art bipotential electron gun.

FIG. 6 shows the result of a computer generated comparison of spot size versus beam current for a prior art bipotential gun with a 5.44 mm diameter lens, represented by curve 90, and a gun having a three element lens system of the present invention with a 5.44 mm diamete lens, an intermediate electrode of length 2.54 mm and 1.27 mm gaps between the intermediate and adjacent electrodes, represented by curve 92. The magnitude of $101_3$ is 5.6 kV, $\Phi_4$ is 14 kV and $\Phi_5$ is 30 kV; and the drift distance from gun to screen was assumed to be approximately 34.3 cm. As indicated by FIG. 6, the lens system of the present invention exhibits an improvement in spot size throughout the beam current range shown without increasing the diameter of the lens.

In addition to improving spot size as compared to prior art bipotential guns, it should be noted that the potential applied to the first lens element, i.e., the lens element closest to the cathode, is lower for an electron gun structure of the type disclosed herein than it is for either the double Einzel lens of Hurakawa et al., the distributed Einzel lens of Schwartz et al. or the tripotential lens of Blacker et al. This results in improved high-voltage stability since the gun structure of the present invention is less sensitive to electrical discharge between the first lens element and the screen grid electrode. Also, the total lens length and number of lens elements are reduced in comparison to the prior art distributed lenses of Hurakawa et al., Schwartz et al., Blacker et al. and Campbell, features which provide a more compact and less complex lens structure.

We claim:

1. In an electron gun for producing and directing at least one electron beam along a beam path, said gun including:

(a) a beam forming region;

(b) a three-electrode coupled focus lens system consisting of a first accelerating and focusing electrode, a final accelerating and focusing electrode and an intermediate accelerating and focusing electrode disposed between said first accelerating and focusing electrode and said final accelerating and focusing electrode, said intermediate electrode forming a substantially cylindrical electron lens element of radius R and length $L_m$ surrounding said beam path where $L_m$ is substantially equal to R; and (c) means for applying a first potential $\Phi_3$ to said first accelerating and focusing electrode, a second potential $\Phi_4$ to said intermediate electrode and a third potential $\Phi_5$ to said final accelerating and focusing electrode, where $\Phi_3 < \Phi_4 < \Phi_5$.

2. An electron gun in accordance with claim 1 wherein said means for applying said first, second and third potentials causes an axial potential profile which is substantially exponentially increasing along said beam path from said first accelerating and focusing electrode to said final accelerating and focusing electrode.

3. An electron gun in accordance with claim 2 wherein $\Phi_4$ is substantially equal to $(\Phi_3 \cdot \Phi_5)^{\frac{1}{2}}$.

4. In an electron gun for producing and directing three electron beam along three substantially coplanar beam paths, said gun including a beam forming region comprising a cathode, a first grid, and a second grid, and a focus lens comprising a first accelerating and focusing electrode next to said second grid and a final accelerating and focusing electrode spaced respectively along the beam paths, the improvement comprising:

(a) an intermediate accelerating and focusing electrode of length $L_m$ disposed between said first accelerating and focusing electrode and said final focusing and accelerating electrode and constituting therewith a three-electrode coupled extended bipotential focus lens, said intermediate electrode comprising first and second electrically conductive bathtub-shaped members joined at their open ends, the closed end of the first member having three apertures of radius R therein, each of which is aligned with a different beam path, R being substantially equal to $L_m$; and (b) means for applying a first potential $\Phi_3$ to said first accelerating and focusing electrode, a second potential $\Phi_4$ to said intermediate electrode and a third potential $\Phi_5$ to said final accelerating and focusing electrode in order to produce an axial potential profile along each of said beam paths which is monotonically increasing from said first accelerating and focusing electrode to said final accelerating and focusing electrode.

5. An electron gun in accordance with claim 4 wherein the increase of said axial potential profile from said first accelerating and focusing electrode to said final accelerating and focusing electrode is substantially exponential.

6. An electron gun in accordance with claim 5 wherein $\Phi_4$ is substantially equal to $(\Phi_3 \cdot \Phi_5)^{\frac{1}{2}}$.

* * * * *

UNITED STATES PATENT AND TRADEMARK OFFICE
CERTIFICATE OF CORRECTION

PATENT NO. : 4,124,810

DATED : November 7, 1978

INVENTOR(S) : David P. Bortfeld et al

It is certified that error appears in the above-identified patent and that said Letters Patent is hereby corrected as shown below:

Column 6, Line 12 "$101_3$" should be --$\Phi_3$--.

Signed and Sealed this

*Sixth* Day of *February 1979*

[SEAL]

*Attest:*

RUTH C. MASON
*Attesting Officer*

DONALD W. BANNER
*Commissioner of Patents and Trademarks*